US006732769B2

(12) United States Patent
Del Campo

(10) Patent No.: US 6,732,769 B2
(45) Date of Patent: May 11, 2004

(54) MODULAR COMPRESSED NATURAL GAS (CNG) STATION AND METHOD FOR AVOIDING FIRE IN SUCH STATION

(75) Inventor: Osvaldo Del Campo, Buenos Aires (AR)

(73) Assignee: GNC Galileo S.A., Beunos Aires (AR)

( * ) Notice: Subject to any disclaimer, the term of this patent is extended or adjusted under 35 U.S.C. 154(b) by 366 days.

(21) Appl. No.: 09/963,628

(22) Filed: Sep. 27, 2001

(65) Prior Publication Data

US 2003/0056960 A1 Mar. 27, 2003

(51) Int. Cl.[7] ..... B65B 1/04; B65B 3/04; B67C 3/02

(52) U.S. Cl. ..... 141/97; 141/82; 141/231; 52/79.1; 52/220.1

(58) Field of Search ..... 141/37, 44, 67, 141/69, 82, 85, 89, 97, 231; 137/364, 377, 382; 52/79.1, 220.1; 48/190; 62/259.1

(56) References Cited

U.S. PATENT DOCUMENTS 4,531,558 A * 7/1985 Engel et al. ..... 141/44
6,176,046 B1 * 1/2001 Quine et al. ..... 52/79.1

* cited by examiner

*Primary Examiner*—Timothy L. Maust
(74) *Attorney, Agent, or Firm*—Harrison & Egbert

(57) ABSTRACT

A modular compressed natural gas station, including a modular compact unit with a flat supporting surface, lateral walls and a detachable roof. At least two different areas are defined inside the modular compact unit: a first anti-explosive area where a set of gas storage vessels and a compressor unit are lodged and a second area where an engine for driving said compressor unit and a measuring bridge unit are arranged. The station is capable of being transported and includes connectors for receiving gas from the general gas pipeline and connector for gas dispenser units. The second area also includes a measuring bridge unit for controlling variables of the station and an electrical switching board.

7 Claims, 5 Drawing Sheets

MODULAR COMPRESSED NATURAL GAS (CNG) STATION AND METHOD FOR AVOIDING FIRE IN SUCH STATION

BACKGROUND OF THE INVENTION

1. Field of the Invention

The present invention is referred to a modular transportable and easy-to-install compressed natural gas (CNG) re-fueling station for replacing traditional facilities for delivering this kind of fuel by a practical, economical solution.

This modular station is a compact solution including several technologies already used separately in traditional CNG re-fueling stations. With the present invention, these solutions are incorporated in a "micro-package" and are used through the application of security engineering techniques or alternative solutions replacing traditional re-fueling gas station constructions as well as traditional security rules.

2. Description of Related Art

CNG re-fueling stations construction has always involved a potential risk of explosion. This problem has been analyzed in different countries under different point of views.

There are two worldwide trends in the market regarding security standards, the European trend and the American trend. The first one tends to avoid the risk, to avoid the use of elements which may produce risky situations, or to manufacture the elements in such a completely safe way for minimizing the risk of accidents and the consequent risk of deaths. The American trend resides on the cost of the risk, that is, focus the problem on the insurance rate. Americans has issued Rule MPTA 52 which allows the construction of compressed natural gas (CNG) re-fueling stations under a series of rules which are less severe than the Argentine, Chilean, Brazilian or Italian regulations. This has an explanation: it is not possible to build CNG re-fueling stations in urban areas of the United States.

Moreover, the urbanization of the United States cities is much more spacious thus compensating security failures with distances between CNG stations and the urban areas. This would be impracticable in some other countries since there are thousand of very old cities whose general urbanization could not be modified.

In a traditional CNG re-fueling station, bringing natural gas to the station site usually involves the following steps: receiving gas from a natural gas feeding pipeline, measuring the gas flow rate through a traditional gas metering plant, compressing gas up to a predetermined pressure (for instance, 250 bar) using a traditional compressor unit, and storing gas at storing gas vessels. Said gas is channeled to the station fuel pump and delivered at a 200 bar of pressure.

For security purposes, in most countries, the present regulation requires the fulfillment of the following requirements:

a) the compressor unit must be installed inside a concrete bunker;

b) inside said concrete bunker, several security measures must be taken;

c) bunker walls must be constructed with reinforced concrete able to support fire for a minimum period of time of three hours.

The applicant is one of the most important CNG related-technologies company in Argentina. From the extensive experience of the applicant in CNG technologies, it may be concluded that the CNG re-fueling stations need an integral solution avoiding long construction times.

The main object of the present invention is developing a technological solution for overcoming the above cited problems, incorporating all the elements included in a traditional CNG station but in a compact "micro package" solution.

Every CNG station needs a "measurement bridge" for measuring the gas flow the station is taking from the general gas pipeline. A bunker lodging storing vessels, including a compression system, a control and logical switchboard is also needed.

With the proposed invention all these elements are incorporated in a single compact "packaged" unit, that is a single transportable unit.

The most important problem to be solved in this project resides in bringing the "packaged" unit purposed to the same to security level as a traditional concrete bunker of a traditional CNG station. This was definitively a great challenge for the present invention, since said traditional bunkers are usually buried and constructed with reinforced concrete.

In accordance with the applicants' knowledge, in the prior art there are no traces of packaged CNG stations including security features as a traditional CNG station.

U.S. Pat. No. 5,676,180 is referred to a system for delivering natural gas, from a pipeline, is loaded onto a movable transport by flowing the gas into multiple pressure vessels equipped with internal flexible bladders which will contain the gas until the pressure in the vessels equalize with the pressure in the pipeline. At that time, the transport will be moved to a compressed natural gas (CNG) re-fueling station. At the re-fueling station, the multiple pressure vessels will be connected to an un-loading duct leading to the storage facilities. The natural gas will be un-loaded by pressure differential until pressures equalize, then pressurized hydraulic fluid will be pumped into the annulus between the bladder and the steel walls of the pressure vessel which will deflate the bladder and squeeze the remaining gas out of the bladder to storage. The transport is then disconnected from the unloading facilities and returned to the pipeline for refilling with natural gas.

Another patents related to CNG stations are U.S. Pat. No. 5,676,180 and U.S. Pat. No. 5,603,360 both of James Teel. None of these patents describe a compact modular high-security solution like the present invention, and there are no traces of a compact ready-to-install and high-security CNG station like the one purposed.

BRIEF SUMMARY OF THE INVENTION

For solving this challenge a modular CNG re-fuelling station is now purposed dividing the inner surface in three different areas: a measurement bridge area, a compression unit area and a control area including an electrical engine, an electrical switching panel or board and the remaining control devices.

Different risk classifications have been assigned to said three areas. In these kind of constructions, an "anti-explosion" classification is defined classifying areas in accordance with the potentiality of gas presence therein. The back side of this module, wherein the electrical engine is installed, has a discriminated classification using a particular security solution like pressurizing the cabin, sensing gas presence permanently for lowering security requirements, allowing the use of traditional engines and cheaper electrical components.

The most important area of this compact station resides on the front area. The front area of a CNG station must be, in accordance with the present regulations, a concrete bunker with a blasting roof and a labyrinthic inlet. Thus, in the case of a explosion inside said bunker, the explosion energy is propagated upwards without affecting the remaining structure. At the same time, a fire barrier is provided for avoiding its propagation.

The present invention provides a solution for preventing and correcting danger situations in CNG stations.

Firstly, danger situations are prevented by controlling the inner bunker atmosphere, installing ventilation systems at the upper part thereof, renewing the cabin air several times per hour avoiding the presence of gas, and simultaneously installing a gas detector inside the cabin which may activate fans forcing the ventilation if gas is detected. On the contrary, if fans are not driven, the machine is stopped and the alarm is activated thus preventing an explosive mixture inside the station.

This CNG station also includes a computer-control device defining an intelligent control equipment through multiple pre-programmed functions. This computer manages all equipment parameters. The cabin itself is constructed with anti-explosive features, particularly the cabin illustrated in the accompanying drawings which is made with 0.51" thickness steel sheet, pneumatic aperture systems which can only be opened through the computer system and uses some closing devices. For example, if the compressor unit is running, the cabin door cannot be opened, and if the cabin is opened, it is not possible to start the compressor unit.

This is the so-called "active security" so that when the cabin is opened the is no risk of explosion due to gas pressure or a great gas leakage because the gas flow is interrupted or the compressor unit is stopped.

The purposed cabin is designed for supporting an explosion and is tested for supporting an inside explosion. The roof may be blasted of f so the explosion energy may be "channelled" upwardly without affecting the remaining structure. There is a closing system comprising pneumatic means for closing the cabin and once doors are closed with several bolts the cabin is ready for supporting an inside explosion without affecting the remaining parts of the station structure. If an explosion occurs or fire is detected inside the cabin, a complex complete anti-fire sequence runs:

- the fire sensor inside the cabin helps the computer to interpret the situation, the gas inlet valve is closed so as to avoid the inlet of further gas,
- an outlet valve is also closed so as to avoid the recession or backward motion of gas flowing from the gas dispenser to the compressor unit,
- gas inside the storage area is automatically vented through a ventilation duct to atmosphere,
- carbonic anhydride is automatically discharged inside the cabin and the computer control unit keeps the doors bolts shut preventing doors opening for 40 minutes so as to avoid the contact between fire and fresh external air.

From the above it may be understood that with the automatic and simultaneous measures taken the fire will be extinguished rapidly. On one hand, gas flow is cut therefore there is no fuel to be burn, and on the other hand, by preventing the opening of cabin doors there is no fresh oxygen to be burn. Obviously, at the same time, the machine is automatically stopped.

Security is one of the most important features of the purposed CNG re-fuelling station defining a compact easy-to-install station safer and cheaper than a traditional CNG station.

Moreover, the risk of an explosion may be analyzed from two different points of view: the risk of an explosion per se and the magnitude of said explosion. The risk is bound, in some way, to different triggering factors. The main triggering factor of an explosion or the presence of an explosive mixture inside a CNG station resides on the presence of personnel inside the cabin. The present invention does not allow the possibility of carrying out maintenance maneuvers while the equipment is running. An operator may open a door of the purposed station only if the equipment is completely stopped, therefore the risk of damages to the personnel in an explosion and the presence of gas inside the cabin is completely null.

Anyway, considering that the present invention envisions several configurations, including for example, two or three compressor units in a single cabin, a risky situation could happen (in which an explosion may occur) while an operator is carrying out maintenance maneuvers inside the cabin.

From the point of view of preventing accidents, the purposed invention includes anti-explosive elements, the presence of operators inside the cabin is avoided, thus avoiding an additional risk factor, and the cabin atmosphere and gas leakages are automatically controlled by the ventilation fans.

As from the point of view of the accident magnitude, the explosion magnitude, there are two possibilities for an explosion. A real explosion or a gas expansion, the latter caused by a leakage in the gas pipelines inside the cabin or the gas storage vessels.

Gas storage vessels are admitted as an intrinsically safe means due to their own safety regulations, but gas pipelines may fail. In this case, more than an explosion per se, as a consequence of an explosion an element may be projected at a very high speed in any direction. This element may hit the personnel with fatal consequences. For checking the purposed safety level of the present equipment the cabin is testing by shooting the walls admitting that the shoot energy is higher than the energy involved in any other possible situation that may really happen.

Considering the explosion caused by the combustion of an explosive atmosphere (cabin inner air plus gas) the purposed equipment is not only tested but conceived from a different standpoint. Traditional CNG bunkers must have aisles around the cabin, since neither lateral surfaces nor walls are able to be moved. In a traditional CNG station, the space necessary for lodging machines, aisles between machines and the storage vessels are very ample, thus the energy which could be accumulated inside the cabin is between 10 to 15 times greater than in the purposed case. Any explosion occurred in a traditional bunker would be several times greater than an explosion inside the purposed station. This is because in the present case the presence of combustion elements inside the cabin is minimized, that is the combustion mixture is minimized.

The cabin volume is the minimum necessary volume for containing the elements thus an explosion may have a minimal effect on the overall structure.

Risk classification areas are divided in a classified area and a non-classified area, defined by the front cabin and the engines cabin. Considering that the compressor's axis traversed from one area to the other, it is properly sealed. The engine is separated from the compressor unit. Said seal avoids an air flow between both areas. The backward area of the cabin is pressurized therefore if there is an exchange between the atmospheres of the different cabin areas, the air of the non-classified atmosphere tends to move towards the classified atmosphere avoiding any risk of explosion.

Comparing the purposed technology with the traditional CNG stations, the present invention reduce between 20–30% installation costs and the time involved is also decreased from four months (traditional CNG station) to a single day. It is installed over a concrete flat floor and it does not need neither any kind of vibrating system nor a sound-proofing system since the cabin is designed so that this kind of requirements are not necessary.

For a traditional CNG station, the complete construction takes between four to five months, by:

constructing the bunker, installing the equipment inside the bunker, constructing the roof, connecting the bunker with the air extraction system, installing the lighting system of said bunker with anti-explosive elements, the equipment must include remote switching means, that is a switching board installed far way from the cabin and corresponding wires must be installed connecting the equipment to said board, connecting the equipment with the storage vessels, connecting the storage vessels to the gas dispensers;

installing in the storage area a manual ventilation system which may be activated outside the cabin.

Said traditional CNG stations requires a manual ventilation system. Present regulations requires an element for minimizing the presence of combustion elements inside the cabin and venting the gas from the storage area.

In the present invention, this goal is obtained through two different elements: manual means and automatic means. Manual means includes a starting button through which ventilation means are opened, and automatic means including sensors for detecting danger situations, capable of opening ventilation means when a risky situation is detected. Said "ventilation" operation consists in opening a valve and discharge the gas of the cabin inner atmosphere to a safe area. For doing so, the present invention includes a ventilation duct, that is, a pipeline extended up to the highest point of the area in which the station is installed. Since gas is lighter than air, it is easily and readily dispersed during an emergency situation.

Any kind of risky situation is thus avoided and a safety level higher that a traditional CNG station is also achieved.

The modular feature of the present CNG station allows its transportation with a crane, with an approximate weight of 12 Tons and may be installed anywhere, for example in an elevated platform.

Basically, the present invention resides on a new anti-explosive completely-compact CNG unit including all the traditional elements of a CNG station, that is a modular CNG station. In a single module, all the problems usually aroused during the construction of a traditional CNG station are solved.

As an alternative, the present invention may include remote controls, that is the station may be installed in a remote site far away from a city and sensors allows the remote operation of the station and a remote maintenance. This concept comprise a completely different concept for CNG stations.

From the inventor's knowledge, there are no CNG stations comprising a similar compact and extremely safe CNG technology in the market. For example, the electrical power consumption is one of the lowest consumption in the CNG stations market, it also has the better flow condition and includes a high-technology and reliable compressor unit. Moreover, said compressor is started through a fuel or gas engine for driving the remaining parts of the equipment thus rendering in a completely autonomous unit.

Summing up, the present invention is referred to a modular compressed natural gas station, characterized by comprising a modular compact unit with a flat supporting surface, lateral walls and a detachable roof, at least two different areas are defined inside said modular compact unit: a first anti-explosive area where a set of gas storage vessels and a compressor unit are lodged and a second area where an engine for driving said compressor unit and a measuring bridge unit are arranged; the station is capable of being transported and includes connectors for receiving gas from the general gas pipeline and connector for gas dispenser units. Said antiexplosive area in defined by fixed walls and at least one door with closing bolts connected to micro-switches in turn connected to the PLC. The engine which drives the compressor unit is selected from the following: electrical engine, gas-feed internal combustion engine, gasoil-feed internal combustion engine, fuel-oil internal combustion engine. Said second area also includes a measuring bridge unit for controlling the following variables of the station through the PLC: vessels inner pressure; line pressure; line electrical tension; compressor exit pressure; atmosphere control. The station includes in the second area an electrical switching board.

The roof of the station comprises a detachable modular structure capable of being detached from the station structure during an explosion and said compressor unit is connected to heat exchangers capable of regulating the temperature of each compression stage.

Moreover, the present invention also comprises a method for avoiding fire in a CNG station characterized by comprising the following steps:

1) a fire sensor is installed inside the station which is connected to a PLC in turn connected to: doors closing systems, gas control systems, ventilation means, and atmosphere control systems;

2) said PLC sends a signal to the gas control system for closing the gas inlet valves and gas outlet valves;

3) said PLC sends another signal to the ventilation means for discharging the air inside the storage area of the station;

4) said PLC send a final signal to the atmosphere control system for discharging carbonic anhydride inside the cabin, 5) said PLC send respective signals to the door closing system for avoiding doors re-opening for 40 minutes.

BRIEF DESCRIPTION OF THE SEVERAL VIEWS OF THE DRAWINGS

In order that the invention may be more clearly understood, it will now be disclosed in greater detail with reference to the accompanying drawings.

DETAILED DESCRIPTION OF THE INVENTION

Figure 1A:
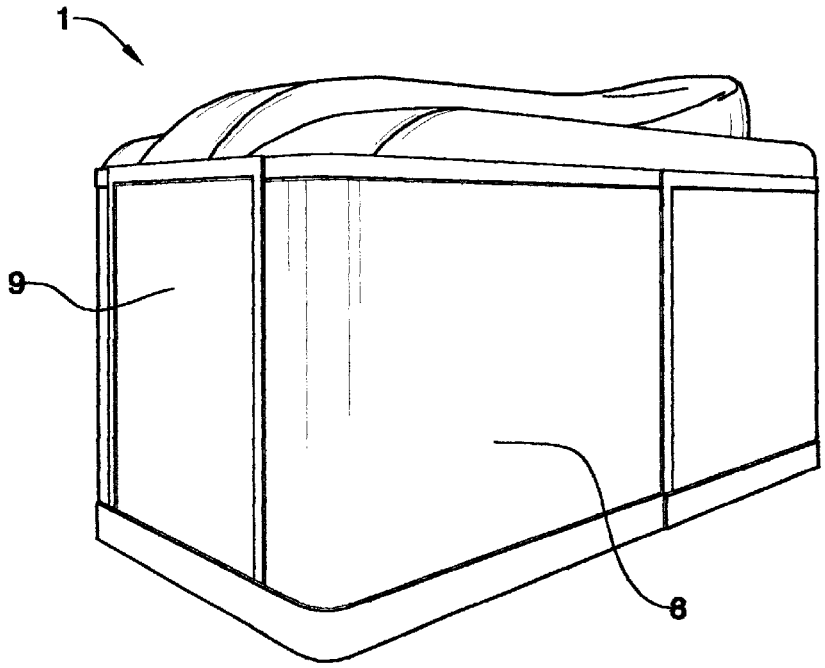
FIG. 1 is a general perspective view of the modular CNG station in accordance with the present invention.
Figure 1B:
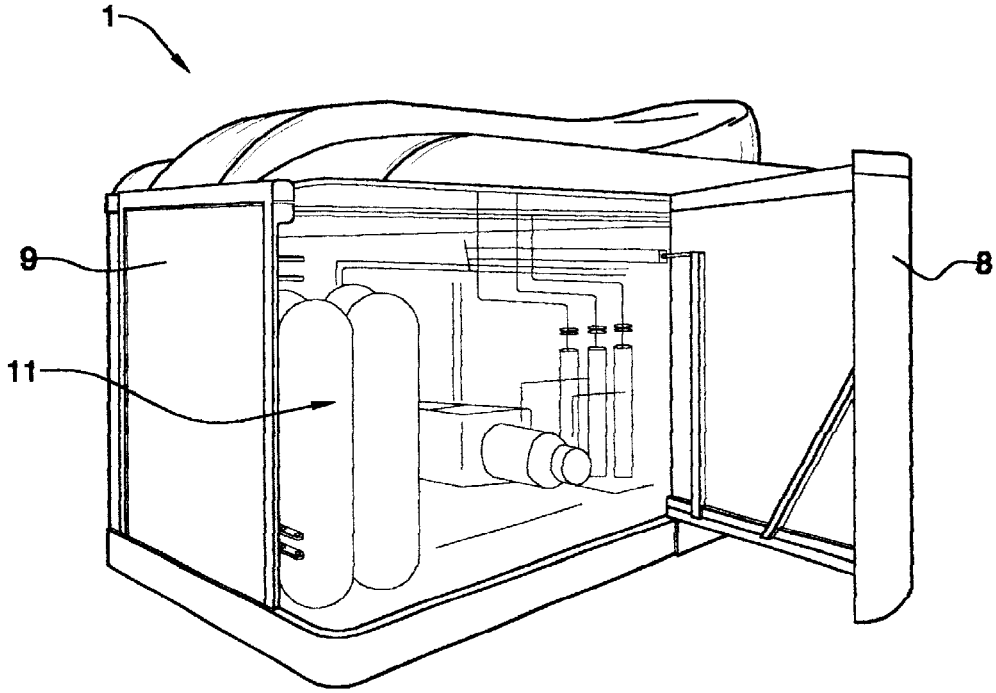
Figure 2:
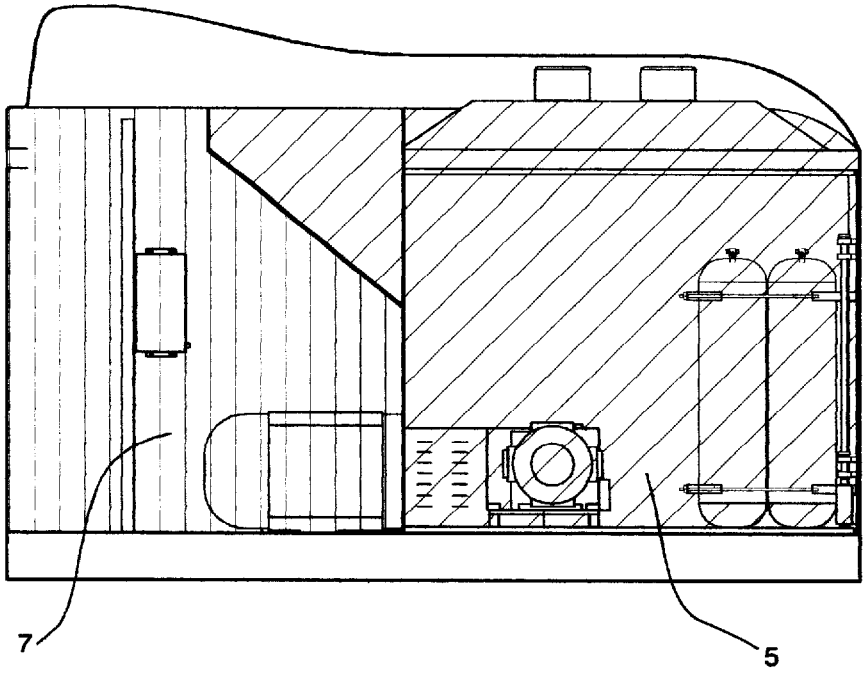
FIG. 2 is a sectional view as indicated with AA line in FIG. 1.
Figure 3:
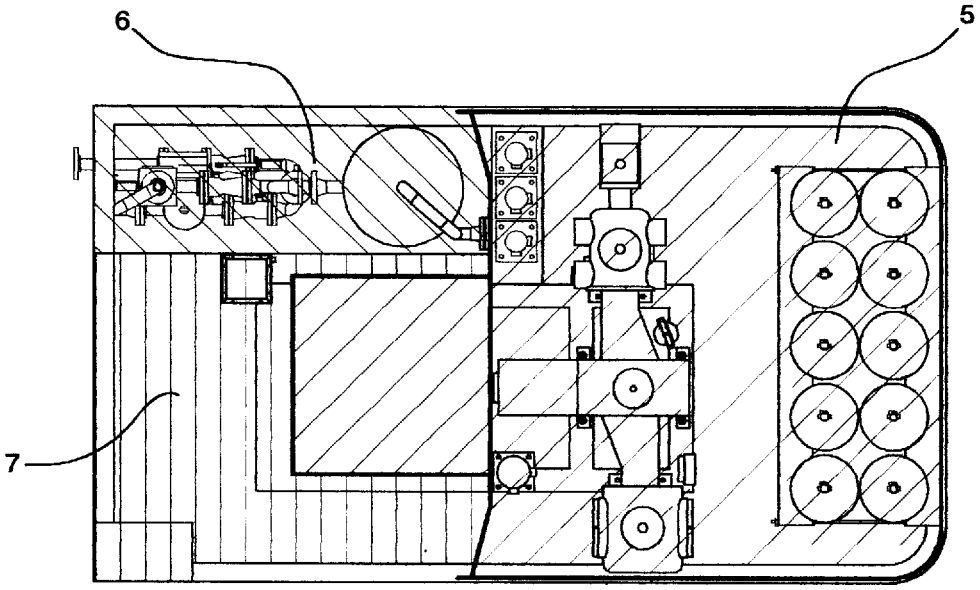
FIG. 3 is another sectional view as indicated with B—B line in FIG. 1, wherein the separation by areas is also illustrated.
Figure 4:
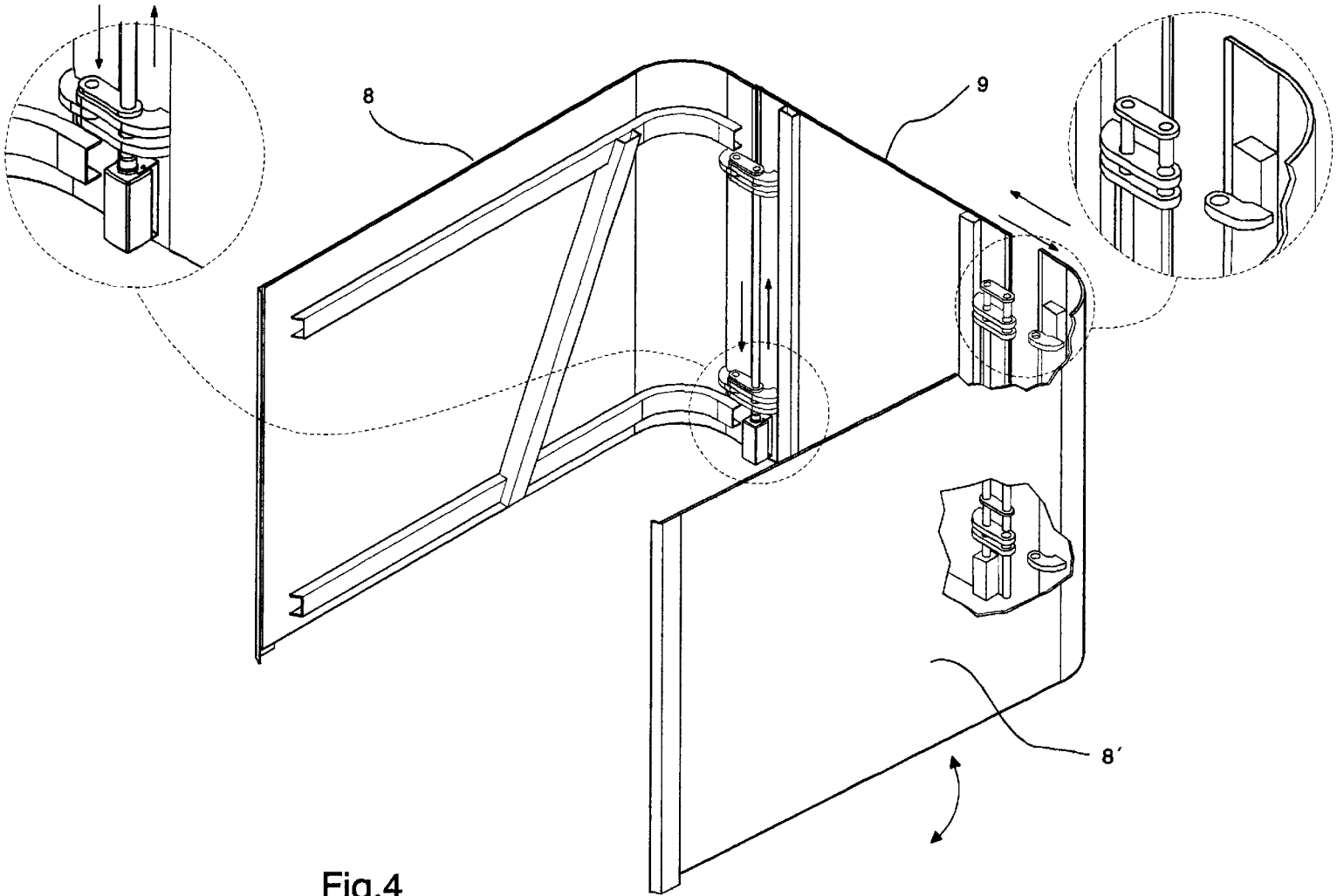
FIG. 4 is a perspective view showing in detail the doors closing system.
Figure 5:
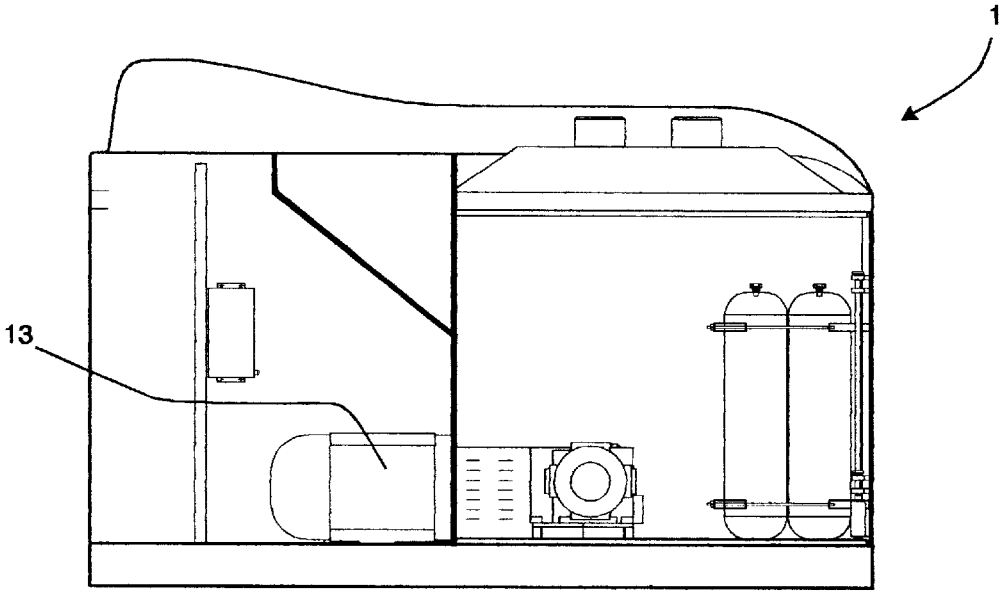
FIG. 5 is a lateral elevational view.
Figure 6:
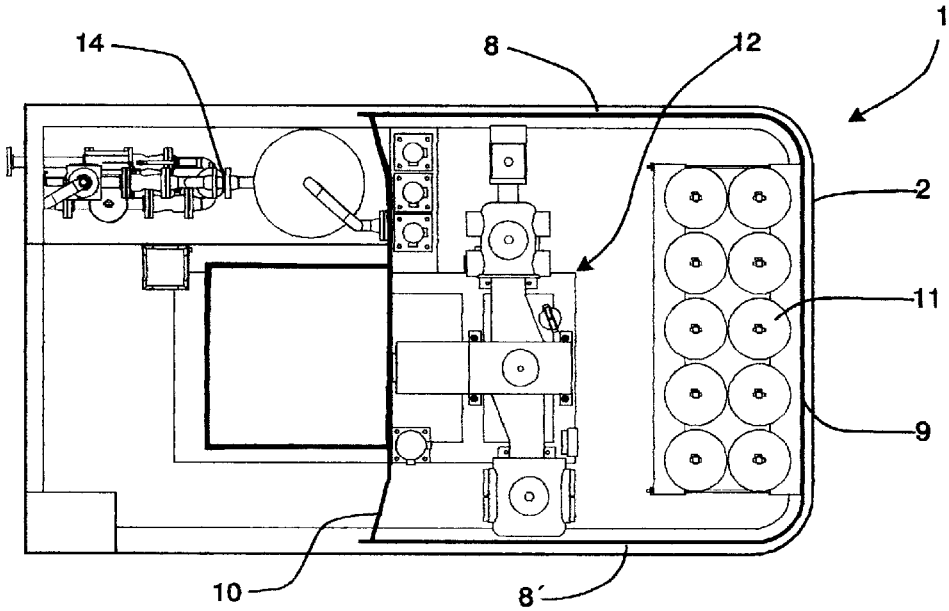
FIG. 6 is a top plan view, finally.

In accordance with the accompanying drawings, the modular CNG station of present invention generally indicated with reference 1, comprises a cabin with lateral walls 2, a roof 3 and a flat supporting base 4. This cabin defines an inner volume where the compressing, regulating and fuel pumping means are lodged. As illustrated in FIGS. 2 and 3 said cabin also defines different areas: bunker area 5, metering area 6, and engines area 7. Bunker area 5 is the area in which the "dangerous" elements of this station are installed, that is the gas vessels, the compressor unit and gas regulating means. Engines area 7 lodges internal combustion engines for driving the compressor units and several other means of the station. Area 6 includes means for measuring parameters such as gas pressure inside the vessels, atmosphere control means inside the cabin, line voltage, etc.

Bunker area 5 will now be described in detail comprising a first bunker door 8, a second bunker door 81, a frontal panel 9 and a rear panel 10. Said panels and doors define an anti-explosive structure.

Closed to the inner side of front wall 9 a set of gas storage vessels 11 are arranged useful for providing a minimal gas volume to the station which is recharged by the compressor units as is expended. Therefore, said set of vessels connected in series between each other have a unique dispenser outlet a well as a unique inlet also connected to the compressor units 12 which in turn take gas from the feeding gas pipeline.

Said compressor units are of the traditional type, take gas from the general feeding gas pipeline, compressing it up to 200 bar of pressure using the traditional method, and is stored in said vessels 11. When a vehicle arrives to the station for re-fuelling CNG, the gas provided is taken from the set of vessels. When the pressure level in said vessels decreases from a determined value, the compressor unit is started channelling the compressed gas directly to the gas dispenser. Once the vehicle has been completely refueled, the compressor unit continues compressing gas up to said vessels re-charging them again.

Said compressor unit is propelled by engines 13 which may be electrical, internal combustion or Diesel engines or any other kind of engines which met the safety and power regulations required for this specific application.

It should be clearly understood that the kind of vessel, engine, and compressor unit used with the present invention does not limit the scope of protection of the present invention since any kind of means may be used if they met the technical and legal requirements for a CNG station. For instance, there are some cities in which the electrical power is cheaper than liquid fuels, therefore in this particular case it could be better to use electrical engines than Diesel engines for propelling the compressor unit. These means are not described in detail since they do not form part of the novel features of the invention.

Variables of this system, that is: inlet line pressure, storage vessels gas volume and pressure, pump consumptions, electrical line tension, etc., are controlled by a PLC (Programmable Logic Controller) and measuring means arranged at the measuring bridge 14.

These means are not described in detail since they are well known for those skilled in the art.

The station also provides an active security system comprising a doors closing system when the equipment is operating. Thus, presence of authorized personnel inside the cabin is not allowed while the equipment is in an operating condition. Doors are automatically closed up to the equipment is completely stopped. In this specification, "equipment" means the engines and the compressor units. With this procedure, the presence of authorized personnel is completely avoided while gas is flowing through the inner pipelines of the station, compressed in the compressor unit and stored in the storage vessels.

For reaching this goal, doors of the purposed CNG station include closing bolts connected to micro switches. Some of said micro switches verify that the doors are closed and others verify the embedding of said bolts. Information obtained from said micro switches is sent to the PLC for checking doors closing and bolt embedding before starting the equipment.

Figure 7:
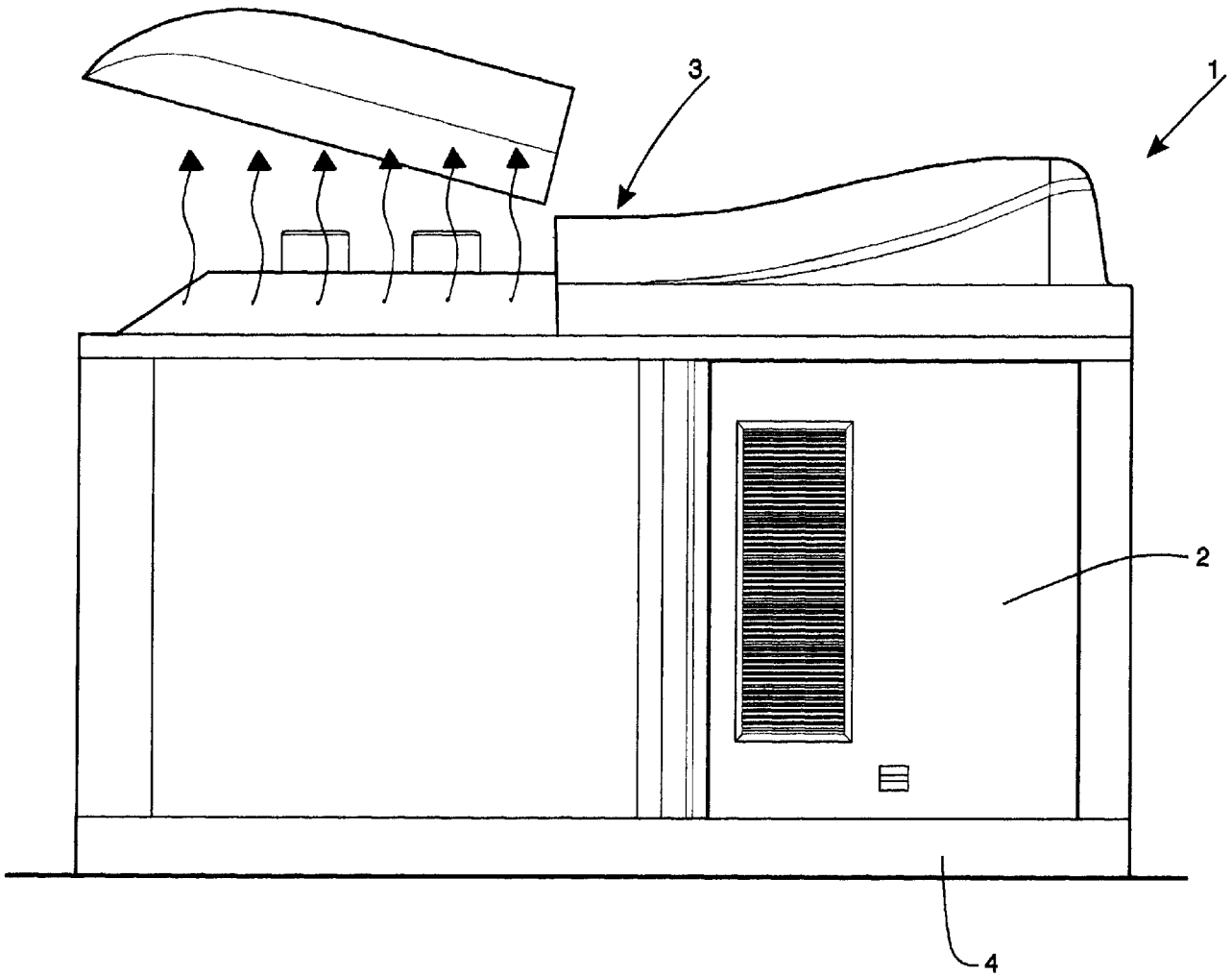
FIG. 7 is a perspective view showing in detail how the roof is detached from the cabin in the case of an explosion.

As illustrated in FIG. 7, the purposed station includes a roof comprising a modular detaching structure. In the event of an explosion said roof will be the "fuse" structure allowing the liberation of the explosion energy. Said FIG. 7 schematically shows how part of the roof is detached during a hypothetical explosive situation.

Moreover, said PLC controls the inner atmosphere of the bunker through sensing means and ventilation means operating coordinately. Said ventilation means are installed in the upper part of the station structure for renewing the inner air several times per hour, avoiding gas presence. A gas detector is also installed inside the cabin which activates said ventilation means if gas is detected or the equipment is stopped and the alarm is activated. Thus the formation of an explosive mixture with potential disastrous consequences is avoided.

The present invention also defines a method for avoiding fire inside a modular compact CNG station comprising the following steps:

1) sensing fire inside the cabin by using a fire sensor unit installed inside the station which is connected to a PLC which in turn is connected to: doors closing systems, gas control systems, ventilation means, and atmosphere control systems;
2) sending signals, once fire is detected to the gas control system for closing the gas inlet valves and gas outlet valves;
3) discharging the air inside the storage area of the station using ventilation means activated by a signal sent by said PLC;
4) discharging carbonic anhydride inside the cabin through the atmosphere control system activated by a signal from said PLC unit,
5) doors re-opening is avoided for 40 minutes by sending a signal from the PLC to the door closing system.

I claim:

1. MODULAR COMPRESSED NATURAL GAS (CNG) STATION, comprising a modular compact unit comprised of a flat floor, lateral walls and a roof; at least two different areas are defined between said walls: a first anti-explosive area where a set of storage vessels and a compressor unit are lodged and a second area where an engine for driving said compressor unit and a measuring bridge unit are arranged; wherein said station is capable of being transported and includes connectors for receiving gas from a general gas pipeline and connectors for gas dispenser units.

2. MODULAR COMPRESSED NATURAL GAS (CNG) STATION, in accordance to claim 1, wherein said anti-explosive area is comprised of four fixed walls and at least one door, and fasten bolts connected to checking microswitches in turn connected to a Programmable Logic Controller (PLC).

3. MODULAR COMPRESSED NATURAL GAS (CNG) STATION, in accordance to claim 1, wherein said engine for driving the compressor unit is comprised of: electrical engines, gas-feed internal combustion engines, gas oil-feed internal combustion engines, fuel-oil internal combustion engines.

4. MODULAR COMPRESSED NATURAL GAS (CNG) STATION, in accordance to claim 1, wherein said measuring bridge unit of the second area also comprises a Programmable Logic Controller (PLC) for controlling the following variables of the station: storage vessels inner pressure; line pressure; line electrical tension; compressor outlet pressure; and cabin inner atmosphere control.

5. MODULAR COMPRESSED NATURAL GAS (CNG) STATION, in accordance to claim 1, further comprising, in the second area of the station, an electrical switching board.

6. MODULAR COMPRESSED NATURAL GAS (CNG) STATION, in accordance to claim 1, wherein said roof of the station comprises a detachable modular structure capable of being detached from the station structure during an explosion.

7. MODULAR COMPRESSED NATURAL GAS (CNG) STATION, in accordance to claim 3, wherein said compressor unit is connected to heat exchangers capable of regulating the temperature of each compression stage.

* * * * *